US006171270B1

(12) United States Patent
Gau

(10) Patent No.: US 6,171,270 B1
(45) Date of Patent: Jan. 9, 2001

(54) APPARATUS FOR DISTRIBUTED AIR PRESSURE MASSAGE

(76) Inventor: Jun-Shyan Gau, Fl.6, No.82,Wu-Gong Road, Shin-Juang City 242,Taipei County (TW)

( * ) Notice: Under 35 U.S.C. 154(b), the term of this patent shall be extended for 0 days.

(21) Appl. No.: 09/232,718

(22) Filed: Jan. 19, 1999

(51) Int. Cl.[7] ..... A61H 9/00
(52) U.S. Cl. ..... 601/150; 601/148
(58) Field of Search ..... 601/150, 151, 601/152, 148, 149, 155; 251/12, 43, 35; 137/102, 512.4, 845, 218, 565.18, 565.34; 606/201, 202

(56) References Cited

U.S. PATENT DOCUMENTS

| | | | | |
|---|---|---|---|---|
| 2,691,504 | * | 10/1954 | Jones | 251/46 |
| 3,279,743 | * | 10/1966 | De La Garza | 251/43 |
| 3,556,122 | * | 1/1971 | Laerdal | 137/102 |
| 3,933,150 | * | 1/1976 | Kaplan et al. | 601/151 |
| 4,311,135 | * | 1/1982 | Brueckner et al. | 601/150 |
| 4,407,275 | * | 10/1983 | Schroeder | 601/152 |
| 4,577,626 | * | 3/1986 | Marukawa et al. | 601/150 |
| 4,583,255 | * | 4/1986 | Mogaki et al. | 601/150 |
| 5,103,854 | * | 4/1992 | Bailey et al. | 137/102 |
| 5,399,072 | * | 3/1995 | Westphal | 137/565.18 |
| 5,437,610 | * | 8/1995 | Cariapa et al. | 601/150 |
| 5,575,762 | * | 11/1996 | Peeler et al. | 606/202 |
| 5,584,798 | * | 12/1996 | Fox | 601/150 |
| 5,830,164 | * | 11/1998 | Cone et al. | 601/152 |
| 5,891,065 | * | 4/1999 | Cariapa et al. | 601/152 |
| 5,915,404 | * | 6/1999 | Satsu | 601/150 |
| 5,931,797 | * | 8/1999 | Tumey et al. | 601/150 |
| 5,997,540 | * | 12/1999 | Zheng et al. | 601/152 |
| 6,007,559 | * | 12/1999 | Arkans | 606/201 |

* cited by examiner

*Primary Examiner*—Justine R. Yu
(74) *Attorney, Agent, or Firm*—Rosenberg, Klein & Lee

(57) ABSTRACT

An air pressure overall massage apparatus is provided having an air pressure supply, which includes a pump to generate air pressure and a functional can connected with the pump. The functional can is also connected with a pressure switch, an electromagnetic valve, an air delivery hole and a pressure controller individually. There is a time clock used for setting operation time and timing. When air pressure is conveyed through an air delivery hole, it can enter into an air delivery hose to fill massage clothes such as trousers. After the setting pressure imposed on the human body is reached at a setting time, the air will escape for a predetermined number of seconds and then fill again automatically. Thus the human body is repeatedly pressured and relaxed again and again to have overall massage effect.

1 Claim, 7 Drawing Sheets

APPARATUS FOR DISTRIBUTED AIR PRESSURE MASSAGE

BACKGROUND OF THE INVENTION

1. Field of the Invention

The invention is directed to an apparatus for air pressure overall, or distributed massage, especially for making use of air pressure to fill user's tight massage clothes or trousers. After the setting pressure imposed on the human body reaches at the setting time, the air will escape for seconds and then fill again automatically. Thus the air repeatedly pressures and relaxes the human body again and again to have overall massage effect.

2. Prior Art

Presently, use of massage devices in the market can be divided into several types as a whole. One is a gravity type, which takes advantage of the gravity of the human body. Two feet step on the massage plates or the slippers covered with different sizes of convexities to massage the acupuncture points of the feet's bottom. However, only the bottom of the feet can be massaged, and it is operated by human force completely. The other is a dynamically continuously shocking type, which uses a motor to drive a shaft to go up and down continuously making shock against the bottom of the feet. Although it can be operated by dynamic, only the bottom of the feet has massage effect. Another is a vibration type. No matter what kind of the dynamic types it is to generate vibration, for example, the eccentric, electromagnetic type or supersonic waves, the operation can be by use of the manual massage or a massage chair. Although the former can massage every part of the human body by turns (In fact, some parts are difficult for the user to reach to massage.), it is still partially taking turns and can not massage the large or whole part of the body at the same time, which may influence massage effect. The latter is also a partial massage over the contacting position of the body and the massage chair.

SUMMARY OF THE INVENTION

An air pressure overall massage apparatus is provided having means for air pressure supply, which includes a pump to generate air pressure and a functional can connected with the pump. When the air pressure is conveyed through an air delivery hole, it can enter into an air delivery hose to fill massage clothes or trousers. Therefore the whole or half of the body is having tight press and relax continuously to satisfy the effect of massage.

DESCRIPTION OF THE PREFERRED EMBODIMENT

Referring to FIGS. 1–5 and FIGS. 8–9 there is shown, the means for air pressure supply 1, the air delivery hose 2, the massage clothes 3A and the massage trousers 3B. The air pressure supply is through the air delivery hose 2 to fill user's tight massage clothes 3A trousers 3B, which expand when air is in and shrink when air is out making his body relaxed and pressed continuously to have massage effect.

Figure 1:
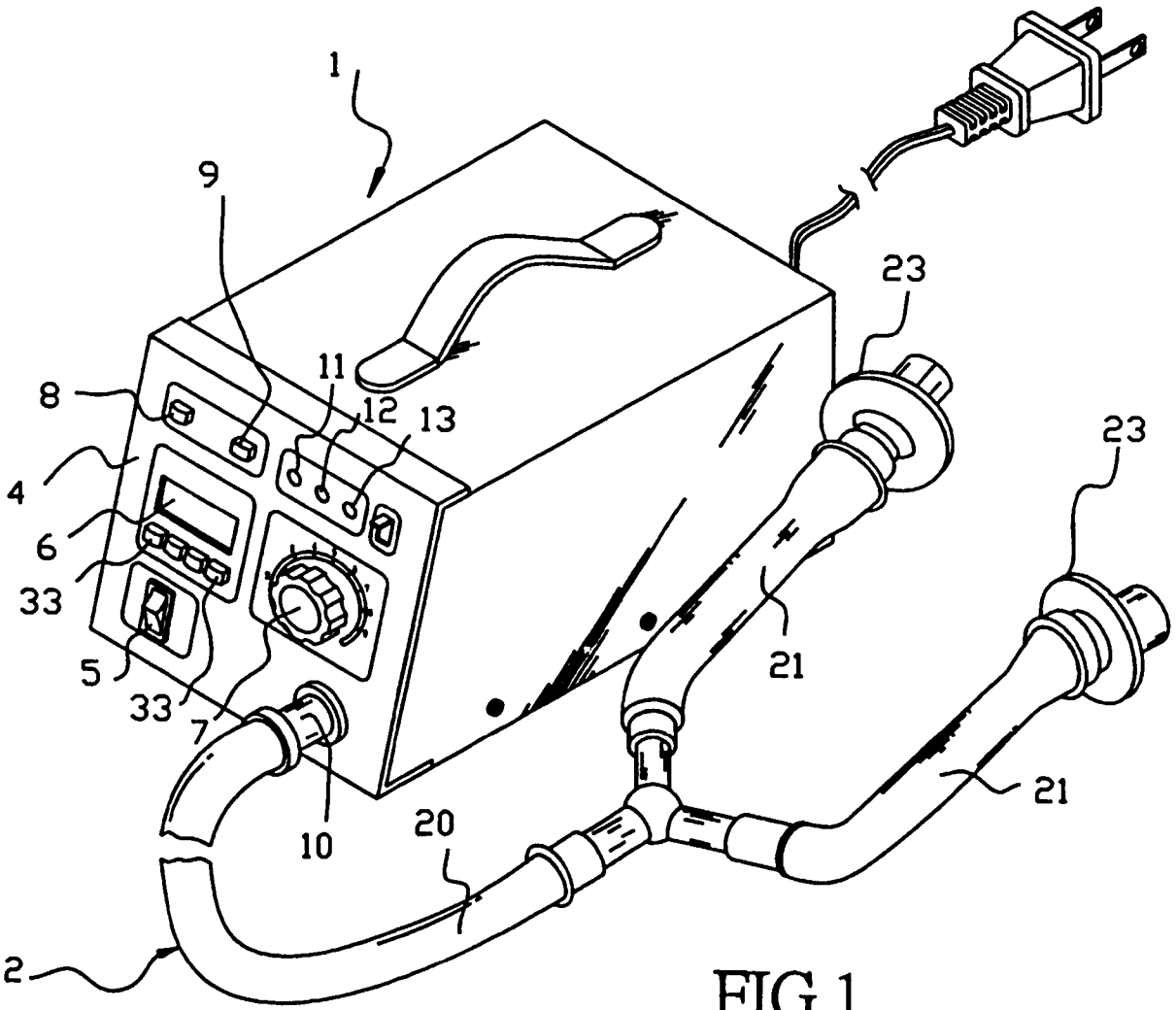
FIG. 1 is a perspective view, massage clothes trousers omitted, of the present invention.

Referring to FIG. 1 there is shown, the front dashboard 4 of the means for air pressure supply 1, power switch 5, the time clock 6 for setting operation time, the pressure controller 7 for setting air pressure, the start button 8, the stop button 9, the air delivery hole 10 for conveying the air to fill massage clothes trousers, the indicating light for operating 11, the indicating light for pressurizing 12, and the indicating light for emergent stop 13.

Figure 2:
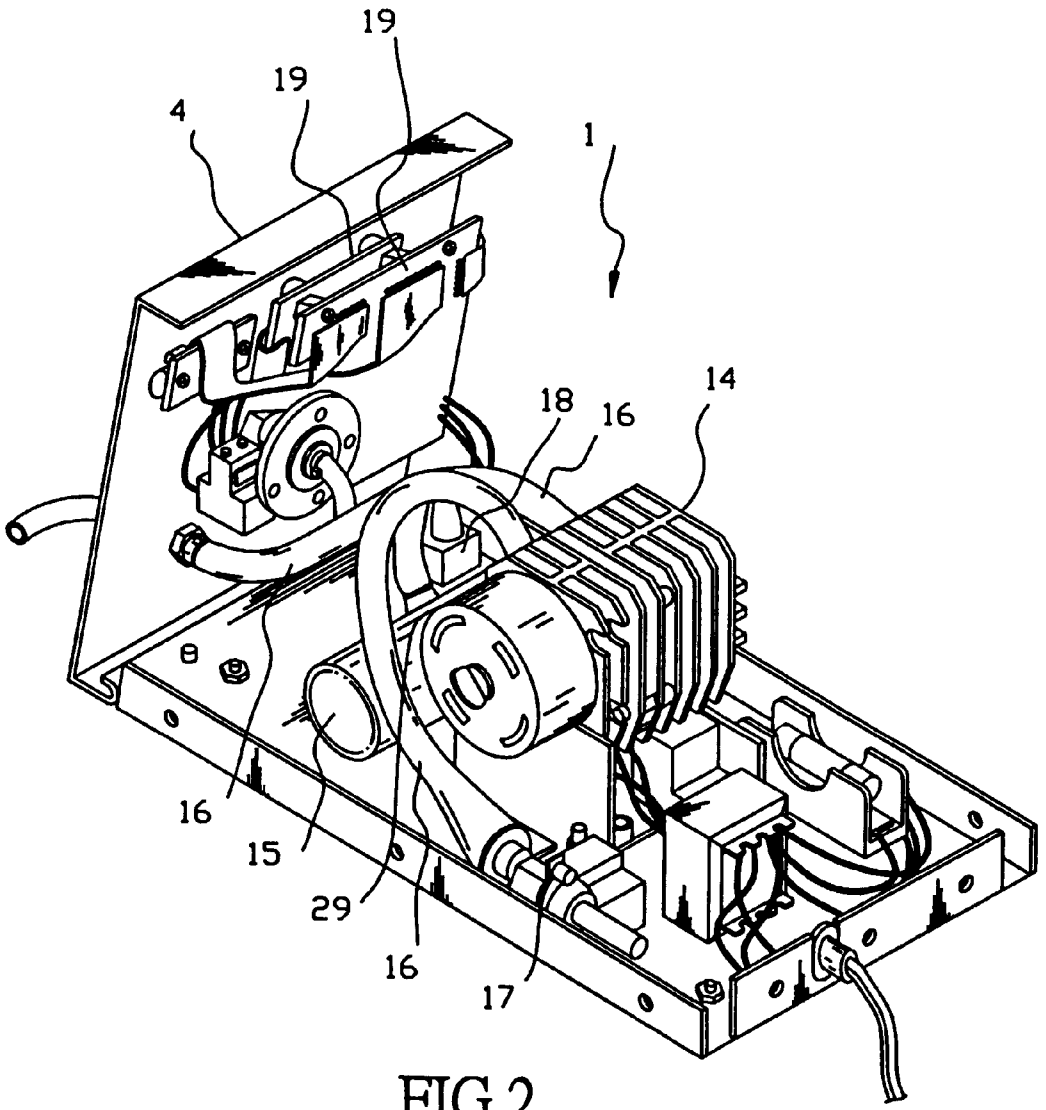
FIG. 2 is a right view of the FIG. 1 removing the cover.
Figure 3:
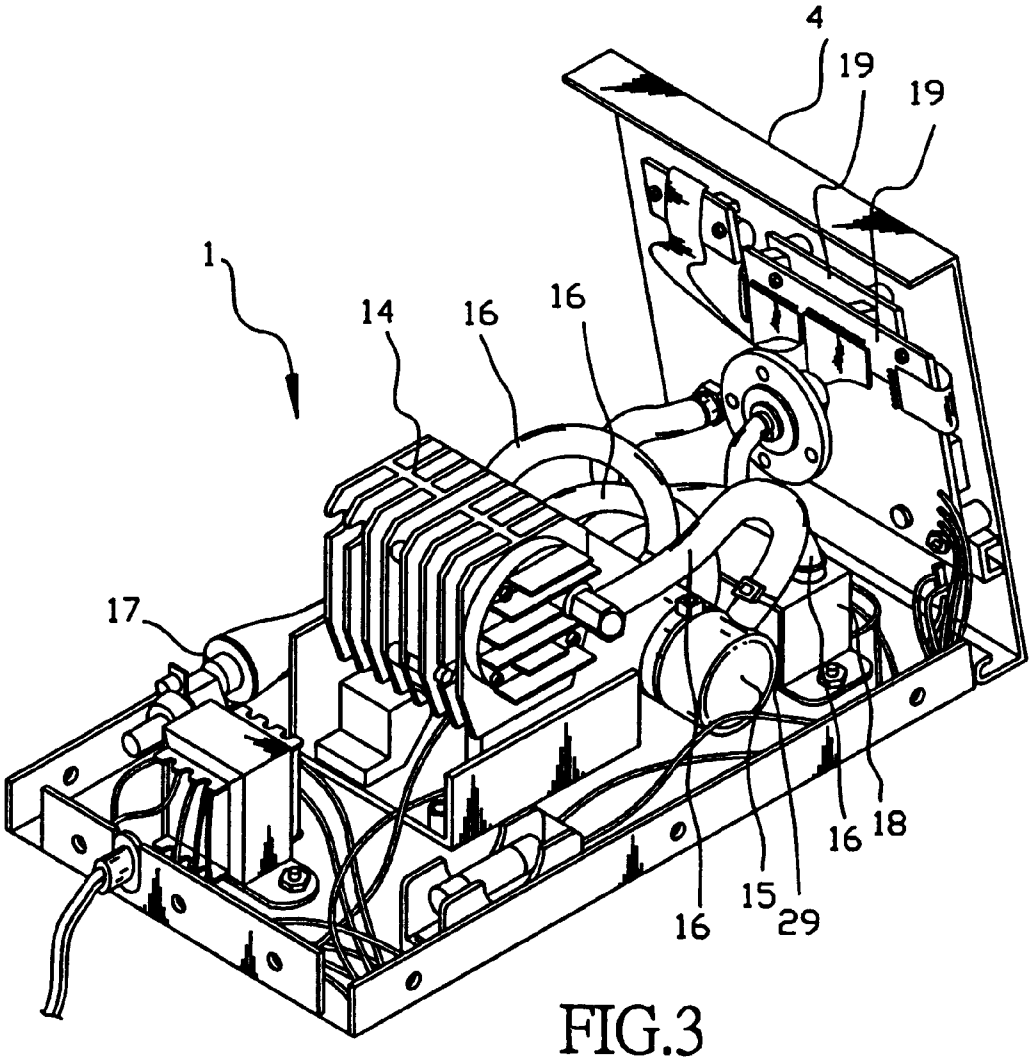
FIG. 3 is a left view of the FIG. 1 removing the cover.
Figure 4:
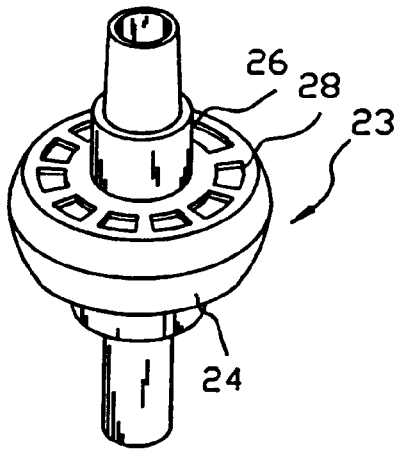
FIG. 4 is a perspective view of the input/output valve of the present invention.
Figure 5:
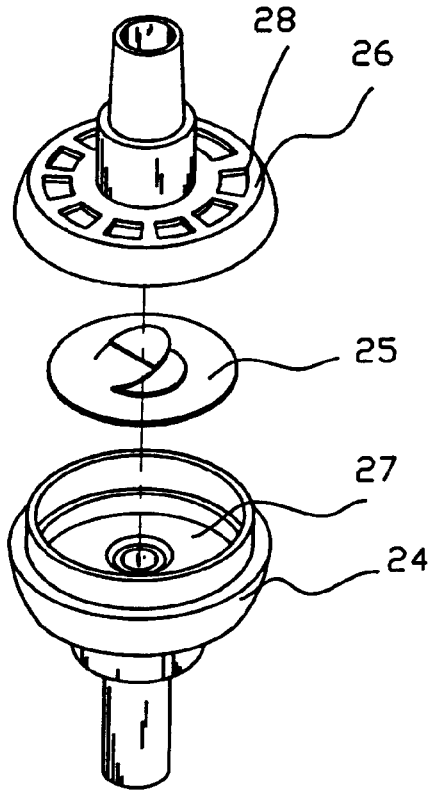
FIG. 5 is an exploded view of the FIG. 4.
Figure 7:
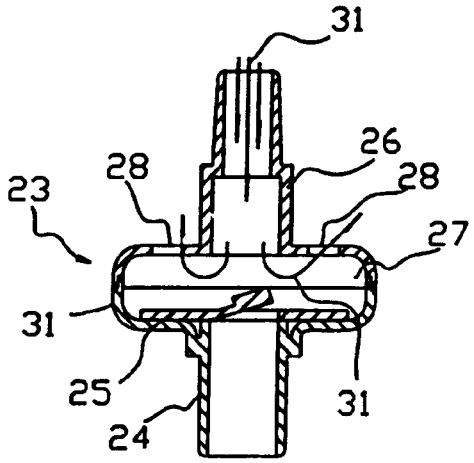
FIG. 7 is an air output functional view of the input/output valve of the present invention.
Figure 6:
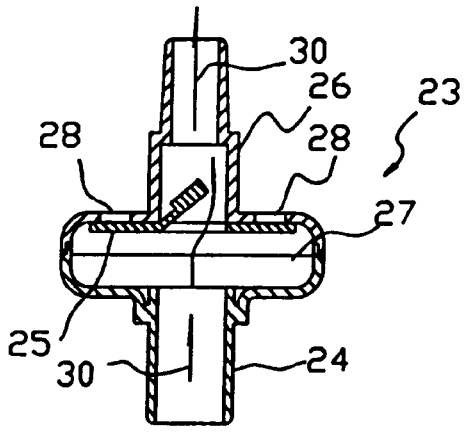
FIG. 6 is an air delivery functional view of the input/output valve of the present invention.

Referring to FIGS.2 and 3 there is shown, the pump 14 connected with the functional can 15 by the connecting pipe 16 is installed in the cabinet of the means for air pressure supply 1. The air pressure is conveyed through the functional can 15, the connecting pipe 16 and the air delivery hole 10. After setting operation time on the time clock 6 connected with the functional can 15 by the connecting pipe 16, and pressing down the start button 8 on the dashboard 4, the pump 14 is driven by the start circuit of the circuit board 19 and the push circuit of the pump 14. During the process of massage, the pressure switch 17 connected with the functional can 15 by the connecting pipe 16 does not only control the start and stop of the pump 14, but also control the electromagnetic valve 18 connected with the functional can 15 by the connecting pipe 16. Through the time clock 6, the pressure switch 17 controls the push circuit of the electromagnetic valve 18 to close the air escape opening 29 when the pump 14 is operating. Therefore, the air pressure generated by the pump 14 is conveyed through the functional can 15, the air delivery hole 10 and the air delivery hose 2 to fill the massage clothes 3A trousers 3B. When the massage clothes 3A trousers 3B expand and reach to the scope of the setting pressure, the pressure switch 17, in addition to control the pump 14 to stop operating, it also controls the electromagnetic valve 18 to open the air escape opening 29 of the functional can 15 to convey the air out. Whereby pressure difference results between two ends of the input/output valve 23 of the manifold 21 end of the air delivery hose 2, and air in the massage clothes 3A trousers 3B conveys out through the air output hole 28 on the input/output valve 23. After the setting time, the time clock 6 controls the electromagnetic valve 18 to close the air escape opening 29 to start the pump 14 for filling air in the massage clothes trousers again. When repeating the process again and again, the massage clothes 3A trousers 3B can tightly press and relax the user continuously.

Referring to FIG. 1 there is shown, one end of the air delivery hose 2 is single general pipe 20 combined with the air delivery hole 10 connected with the functional can 15 to convey the air pressure generated by the pump 14 through the functional can 15. The other end of the general pipe 20 diverges into two or more manifolds 21. One end of every manifold 21 is connected with the input/output valve 23 separately to insert the air faucet 22 on the massage clothes 3A or trousers 3B. Thus massage clothes 3A trousers 3B expand when the air pressure is conveyed in and shrink when the air is out. Referring to FIGS.4–7 there is shown, the input/output valve 23, the air delivery cover faucet 24, the one-way diaphragm 25, and the air output cover faucet 26. Both of the air delivery cover faucet 24 and the air output cover faucet 26 individually having a round tube on one end and a disk on the other end are combined by the disks forming a round convex camber space 27. The air pressure generated by the pump 14 is conveyed through the air delivery hose 2 following the arrow direction 30 to get into the input/output valve 23. When the one-way diaphragm 25 placed in the round convex camber space 27 is pushed by the air pressure to block up a plurality of air output holes 28 on the disk of the air output cover faucet 26, the air pressure can be conveyed through the center valve to fill the massage clothes 3A trousers 3B. When the setting pressure is reached, the pump 14 will stop operating because of the function of the pressure switch 17, and the electromagnetic valve 18 will open the air escape opening 29 to convey the air out resulting in the disappearance of the pressure in the round tube of the air delivery cover faucet 24.

Due to the pressure difference, that is, the pressure in the air output cover faucet 26 is larger than that in the air delivery cover faucet 24, the air pressure in the massage clothes 3A trousers 3B will follow the arrow direction 31 and push the one-way diaphragm 25 away from the air output hole 28 to make the massage clothes 3A trousers 3B shrunken.

Figure 8:
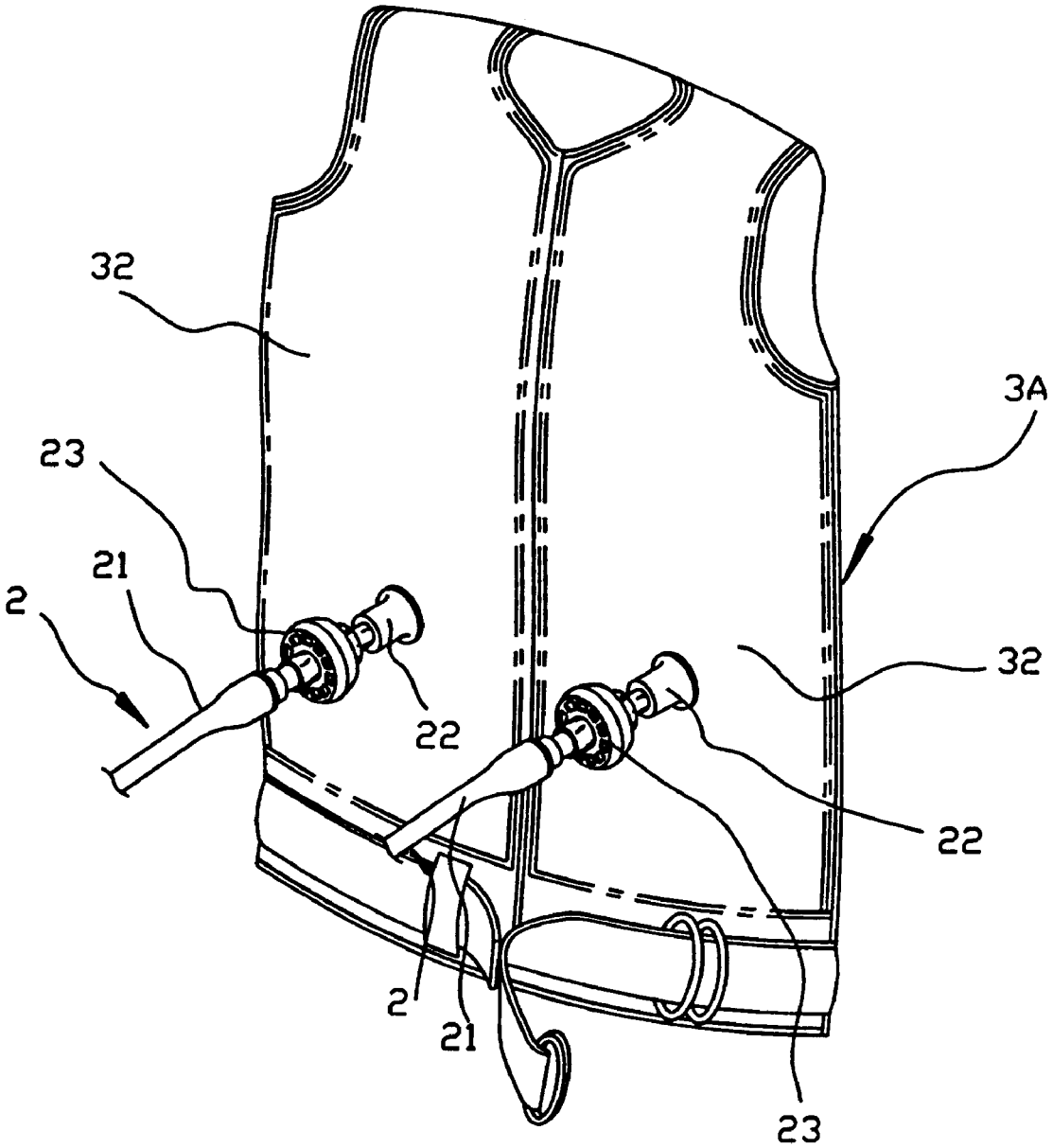
FIG. 8 is a perspective view of the massage clothes of the present invention.
Figure 9:
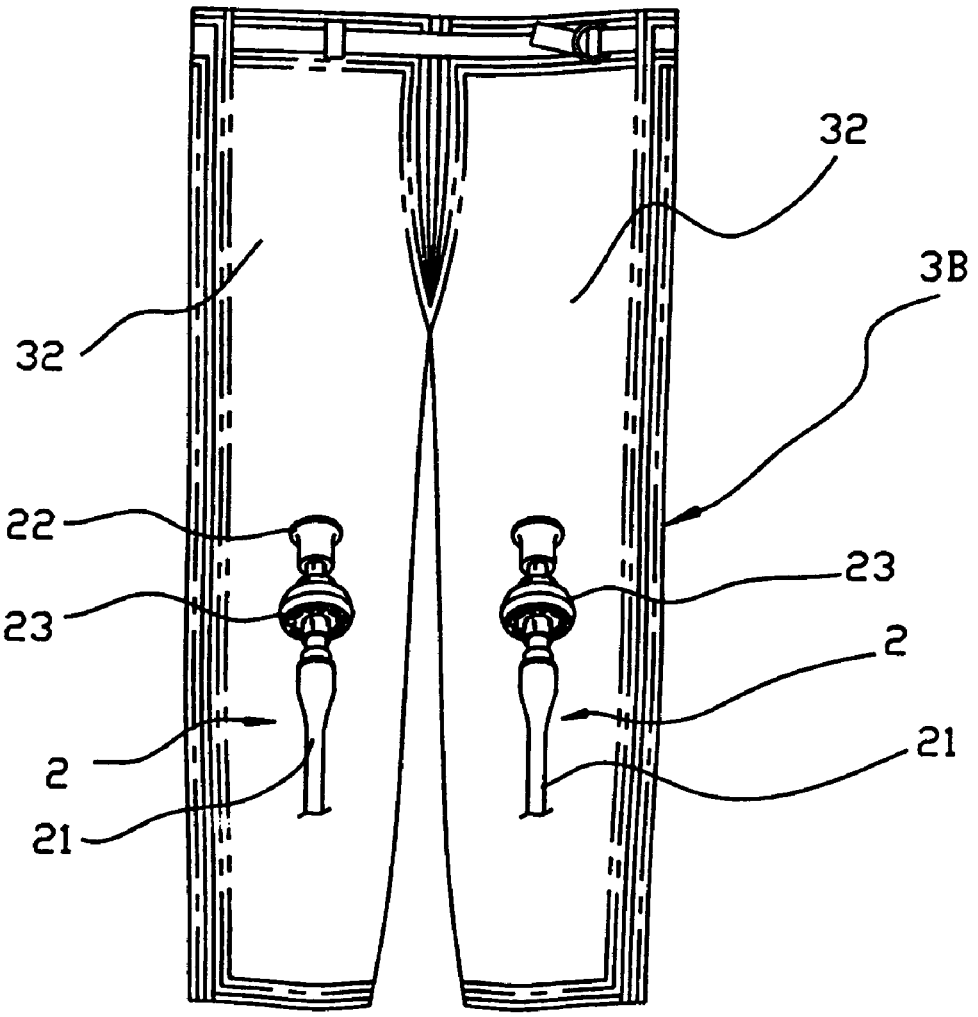
FIG. 9 is a perspective view of the massage trousers of the present invention; and, FIG. 10 is a functional diagram view of the present invention.

Referring to FIGS. 8–9 there is shown, the tight massage clothes 3A trousers 3B, made of two layers of the airtight cloth, are divided into two or more zones 32. To cause every zone 32 to expand individually, there is an air faucet 22 set in every zone 32 to insert and connect with the input/output valve 23 of the air delivery hose 2.

Figure 10:
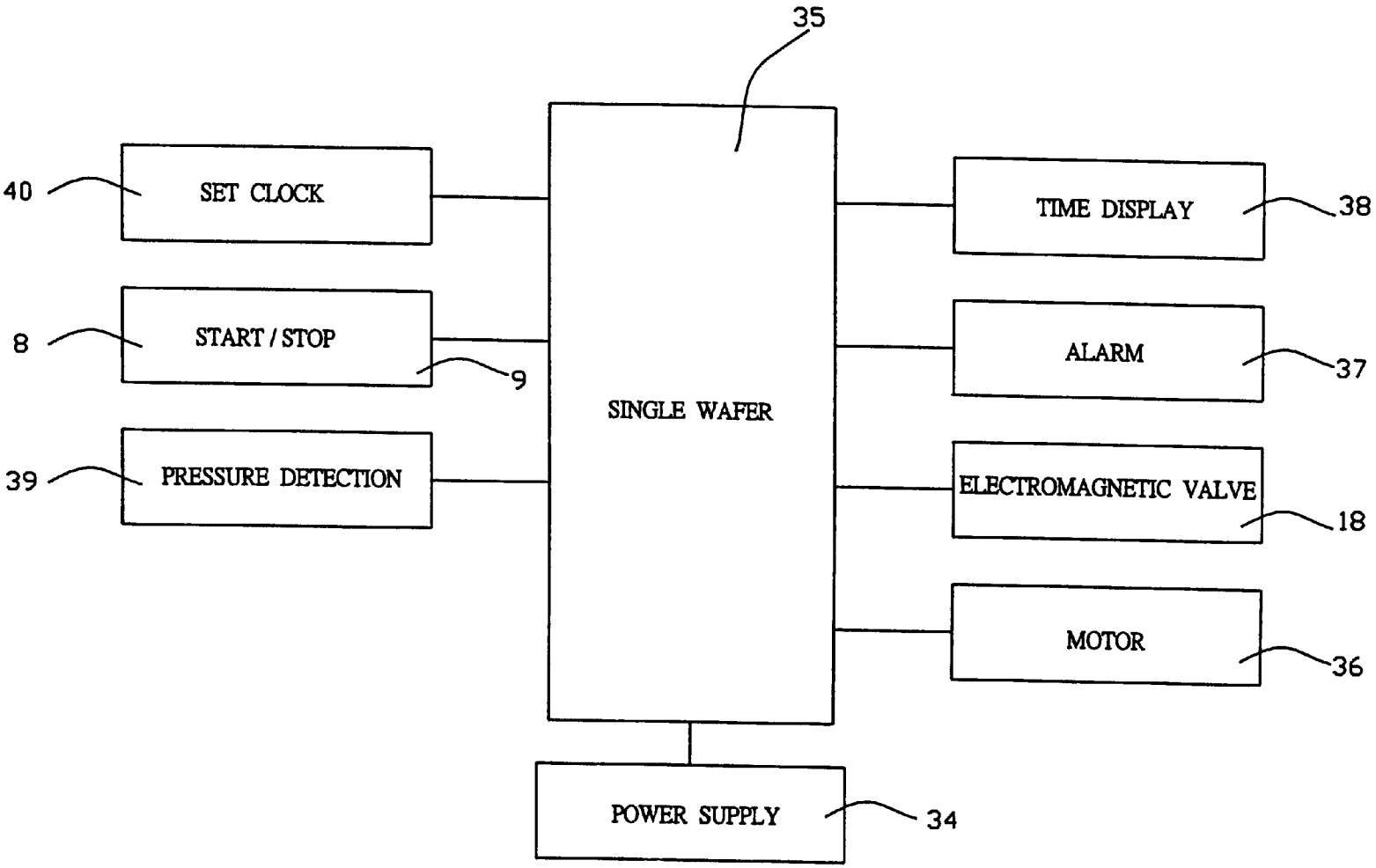

Referring further to FIG. 10, after pressing down the power switch 5, the electric source will provide 5 volt to the single wafer 35 and 12 volt to the electromagnetic valve 18 and the alarm 37. Then, the user is dressed in the massage clothes 3A or trousers 3B, pulls up the zipper, fastens the waistband and connects the air delivery hose 2 between the air faucet 22 and the air delivery hole 10. After pressing down the operation time button 33 on the time clock 6, and revolving the pressure controller 7 to set the massage pressure, the user may press down the start button 8 to close the air escape opening 29 by means of the electromagnetic valve 18. At the same time, the time clock 6 begins to time the operation and the pump 14 operates to generate air pressure conveyed through the functional can 15, air delivery hole 10 and the air delivery hose 2 to fill the massage clothes 3A trousers 3B. When the massage clothes 3A trousers 3B expands and reaches to the setting pressure, the pressure switch 17 is driven to stop the operation of the pump 14 and the time clock 6 is touched off to time. After the human body being pressured for 4–6 seconds, the time clock 6 will drive the electromagnetic valve 18 to open the air escape opening 29 to convey the air out resulting in pressure difference between two ends of the input/output valve 23. After air escaping from the massage clothes 3A trousers 3B for 4–8 seconds, the electromagnetic valve 18 automatically closes the air escape opening 29 and the pump 14 starts to fill the massage clothes 3A trousers 3B again. Thus the massage clothes trousers repeatedly press, pressure and relax the user again and again to have overall massage effect. Finally, the massage apparatus will end the operation and make sounds when the setting operation is at the zero adjustment. There is an extraordinary attention device installed in this massage apparatus to make warning sounds to remind the user. If the clothes are torn, the motor 36 will stop working automatically after continuously pressurizing for 4 minutes. Besides, if the pressure detector is ineffective, the motor 36 will stop working at the maximum pressure value.

I claim:

1. A system for distributed massage of a bodily region:

(a) an inflatable garment to be worn on at least a portion of the bodily region, said inflatable garment having a plurality of inflatable zones;

(b) a supply for generating a pressurized gaseous flow, said supply including a pump for generating said pressurized gaseous flow and a functional can coupled thereto for conveying said pressurized gaseous flow, said pressurized gaseous flow being characterized by a pressure parameter;

(c) adjustable means coupled to said supply for automatically controlling actuation thereof, said adjustable means being operable to periodically actuate said supply for inflating said inflatable zones to a predetermined inflation pressure and periodically inhibit said supply for permitting deflation of said inflatable zones, respectively during predetermined massage and settling periods, said adjustable means including an electromagnetic valve coupled to said functional can and operated to selectively provide open communication between said functional can and a vent opening for at least partial escape of said pressurized gaseous flow therefrom; and, (d) a delivery conduit extending between said supply and said garment for passage of said pressurized gaseous flow therethrough, said delivery conduit including:

(1) a manifold for distributing said pressurized gaseous flow;

(2) a plurality of manifold pipes each extending from said manifold to one of said inflatable zones of said garment; and, (3) a plurality of bidirectional valves respectively coupled to a distal end of said manifold pipes adjacent a respective one of said inflatable zones of said garment, each said bidirectional valve being reconfigurable between first and second states responsive to a pressure differential established by said electromagnetic valve operation, each said bidirectional valve being operable to pass therethrough at least a portion of said pressurized gaseous flow into one said inflatable zone in said first state and to pass therethrough at least a portion of said pressurized gaseous flow out of one said inflatable zone in said second state, each said bidirectional valve includes:

(i) a delivery cover faucet having a first disk body portion and an elongate first tube portion extending coaxially therefrom and connected to said distal end of a corresponding one of said manifold pipes;

(ii) an output cover faucet having a second disk body portion on one end thereof coupled to said delivery cover faucet to define a chamber space therebetween and an elongate second tube portion extending coaxially from said second disk body portion coupled to a respective inflatable zone, said second disk body portion having formed therein a plurality of output holes in open communication with said chamber space; and, (iii) a one-way diaphragm disposed within said chamber space, said one-way diaphragm overlaying and blocking said plurality of output holes responsive to said pressure differential being defined by a greater pressure in a respective manifold pipe than in a corresponding inflatable zone, said one-way diaphragm being linearly moved in its entirety to unblock said plurality of output holes responsive to said pressure differential being defined by a lesser pressure in a respective manifold pipe than in a corresponding inflatable zone established by said operation of said electromagnetic valve.

* * * * *